US005215299A

United States Patent [19]

Luft

[11] Patent Number: 5,215,299

[45] Date of Patent: Jun. 1, 1993

[54] SPRING ELEVATOR SYSTEM FOR PAPER SUPPLY

[75] Inventor: Carl A. Luft, Lima, N.Y.

[73] Assignee: Eastman Kodak Company, Rochester, N.Y.

[21] Appl. No.: 858,801

[22] Filed: Mar. 27, 1992

[51] Int. Cl.[5] ..... B65H 5/16

[52] U.S. Cl. ..... 271/160; 221/279

[58] Field of Search ..... 271/160, 147, 126, 128, 271/30.1, 24, 22; 221/231, 226, 232, 279

[56] References Cited

U.S. PATENT DOCUMENTS

| | | | |
|---|---|---|---|
| 546,154 | 9/1895 | Hoyt | 221/231 |
| 2,181,995 | 10/1938 | Keil | 271/88 |
| 2,734,744 | 2/1956 | Backhouse | 271/62 |
| 3,087,725 | 4/1963 | Duncan | 271/71 |
| 3,173,684 | 3/1965 | Binzoni et al. | 271/57 |
| 3,640,521 | 2/1972 | Hutley | 270/61 F |
| 4,350,328 | 9/1982 | Katakura et al. | 271/22 |
| 4,362,297 | 12/1982 | Landa | 271/152 |
| 4,455,115 | 6/1984 | Alger et al. | 414/21 |
| 4,509,734 | 4/1985 | Rutishauser | 271/10 |
| 4,664,507 | 5/1987 | Fukae et al. | 355/3 SH |
| 4,711,443 | 12/1987 | Fujiwara et al. | 271/126 |
| 4,765,605 | 8/1988 | Abbott | 271/147 |
| 4,805,890 | 8/1989 | Martin | 271/203 |
| 4,953,748 | 9/1990 | Wheelock | 271/160 X |
| 5,005,820 | 4/1991 | Leemhuis | 271/127 |

*Primary Examiner*—David H. Bollinger
*Attorney, Agent, or Firm*—J. Gary Mohr

[57] ABSTRACT

A paper supply tray having a constant force spring operated elevator platform for holding a stack of print receiving material is provided for use in a reproduction apparatus. The constant force spring in conjunction with a sheave and cable system moves the elevator platform such that the top sheet of the stack of sheets contained on the elevator platform is positioned for serially feeding by a sheet feeding mechanism. As sheets are fed from the stack, the constant force spring moves the elevator platform over a vertically guided path to maintain the top sheet of the stack in position for feeding by the feeding mechanism.

4 Claims, 7 Drawing Sheets

SPRING ELEVATOR SYSTEM FOR PAPER SUPPLY

BACKGROUND OF THE INVENTION

1. Field of the Invention

The present invention generally relates to a reproduction apparatus, and more particularly, to an apparatus for storing print-receiving material, such as sheets of paper, to be serially fed during a reproduction cycle.

2. Description of the Prior Art

In a reproduction apparatus, such as a copier or a printer, paper is held in a sheet supply tray and fed, one sheet at a time, during reproduction. Frequently, the sheet supply trays used in the reproduction apparatus are of the type which hold a large amount of paper; for example, a stack of 500 sheets or more. To reload the supply tray, the tray is usually slideably removed from operational engagement within the copier, a stack of paper is placed onto the tray and the tray is slideably returned to its operating position within the copier. Normally, when such high capacity sheet trays are used, they are mounted on powered elevator mechanism to vertically move the tray to a position where the top copy sheet may be transported by a feed roller system, contained within the reproduction apparatus, to the portion of the reproduction apparatus where the toner powder image is transferred from the photoconductive member to the copy sheet. This type of motor driven elevator system, however, is expensive and usually requires a higher voltage than the 110 voltage used in small low cost desk reproduction apparatus.. Low cost desk reproduction apparatus, therefore, are usually restricted to using cassette paper supply trays that normally have a capacity of between 25 to 50 sheets. This avoids the need for a power elevator, since with a limited number of sheets, a spring biased tray is all that is needed to maintain the top sheet in the cassette in contact with the paper feed mechanism of the copier. Therefore, with the need for the powered elevator eliminated, the cost and power consumption associated with a power elevator is avoided making for a practical, but supply limited solution to the problem of high capacity supply trays for low cost desk copiers.

While U.S. Pat. No. 5,005,820 discloses a high capacity tray for low cost desk copiers not requiring a motorized elevator system, the tray has many cooperating parts which subject it to jamming. In addition, the tray requires operator adjustments, which if not performed properly, may lead to jamming. The present invention, unlike U.S. Pat. No. 5,005,820, requires minimal parts and has no operator adjustments, thereby minimizing the chances of jamming.

SUMMARY OF THE INVENTION

It is an object of the present invention to provide a reliable low cost high capacity paper supply tray for a low cost desk top reproduction apparatus.

It is also an object of this invention to provide a spring biased high capacity paper supply tray for use with a low cost reproduction apparatus thereby avoiding the need for elevator motors.

It is still another object of this invention to provide a paper supply tray that maintains the same contact force between the top sheet of paper in the paper supply tray stack and a feed roller mechanism of the reproduction apparatus as the number of sheets in the tray decreases from a large number, such as 500 to 0.

The above objects are accomplished by a sheet supply apparatus for use in a reproduction apparatus, such as a copier or printer, comprising:

a tray assembly;

an elevator platform located within said tray assembly for receiving and holding multiple sheets directly on the elevator platform, piled one upon another to form a stack;

guide means for guiding the movement of the elevator platform between multiple positions with all positions being perpendicular to each other;

a spiral constant force spring located within the tray for moving and maintaining the elevator platform such that the sheets of the stack may be serially fed for use by the reproduction apparatus; and connecting means for connecting said spiral constant force spring to the elevator platform.

The invention, and its objects and advantages, will become more apparent in the detailed description of the preferred embodiment presented below.

DESCRIPTION OF THE PREFERRED EMBODIMENT

Figure 1:
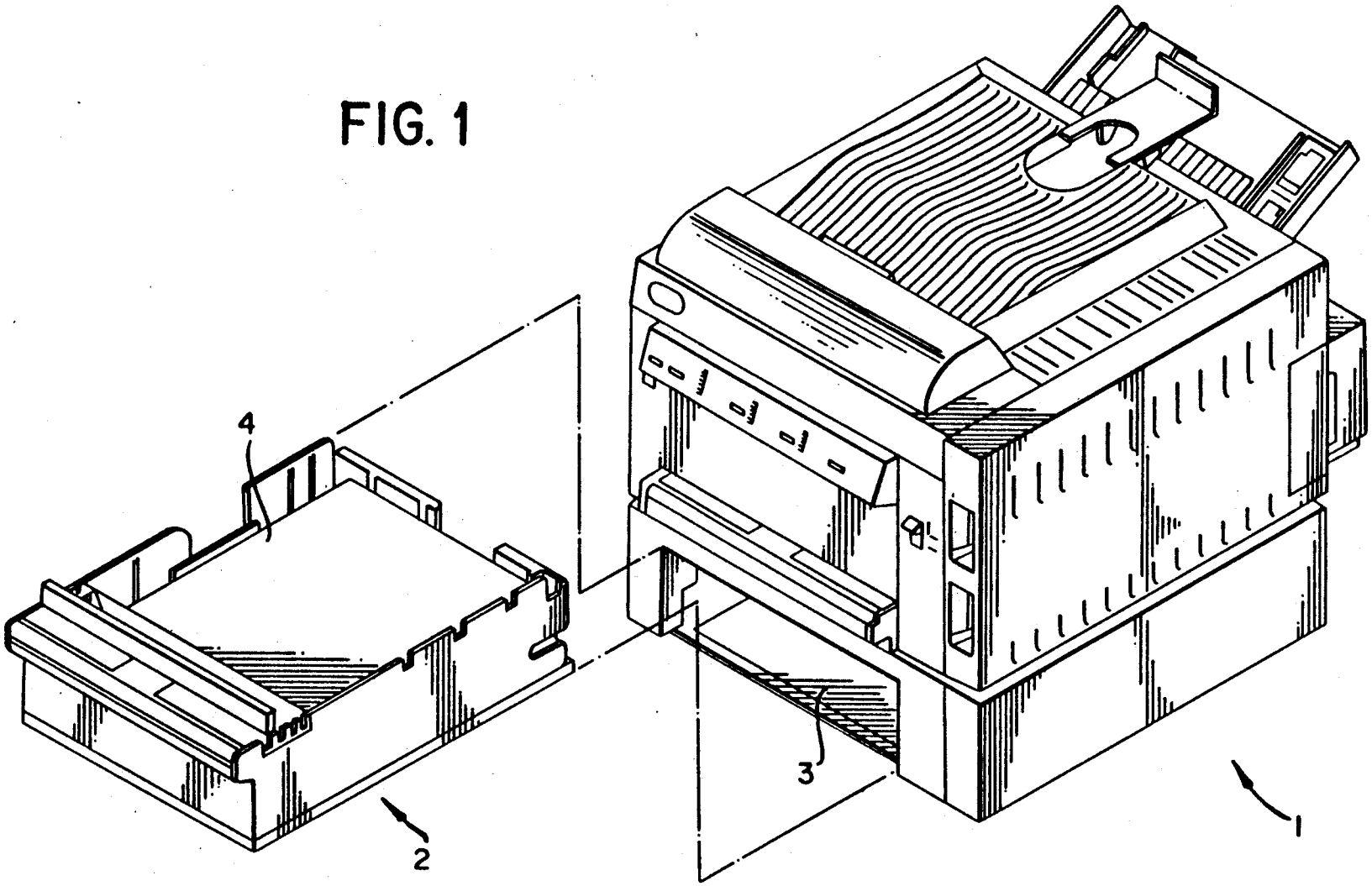
FIG. 1 is a perspective view of a reproduction apparatus and its paper supply tray.

In describing the preferred embodiment of the present invention, reference is made to the drawings, wherein like numerals indicate like parts and structural features in the various views, diagrams and drawings.

While this invention is susceptible of many embodiments, there is shown in the drawings and will herein be described in detail a preferred embodiment of the invention. It should be understood, however, that the present disclosure is to be considered as an exemplification of the principles of the invention and is not intended to limit the invention to the embodiment illustrated and/or described.

The precise shapes and sizes of the components herein described are not essential to the invention unless otherwise indicated, since the invention is described only with reference to an embodiment which is simple and straightforward.

For ease of description, the apparatus will be described in a normal operation position, and terms such as upper, lower, horizontal, etc. will be used with reference to the normal operation position. It will be understood, however, that this apparatus may be manufactured, stored, transported and sold in an orientation other than the normal operation position described.

Much of the apparatus disclosed herein has certain conventional drive mechanisms and control mechanisms the details of which, though not fully illustrated or described, will be apparent to those having skill in the art.

In a typical electrophotographic process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet that has been supplied from a paper supply tray. The toner particles are heated to permanently affix the powder image to the copy sheet and the copy is then sent to an output tray for pick-up by an operator.

Figure 6:
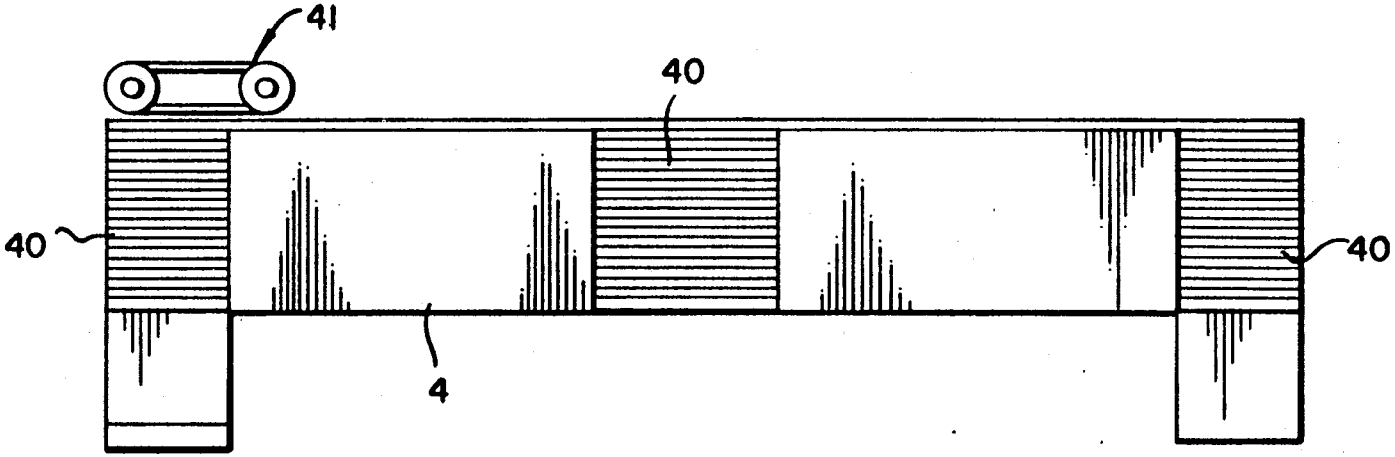
FIG. 6 is a side view of the elevator platform section of the paper supply tray with parts removed for clarity, shown adjacent to a known belt roller scuff paper feed mechanism of the reproduction apparatus.
Figure 7:
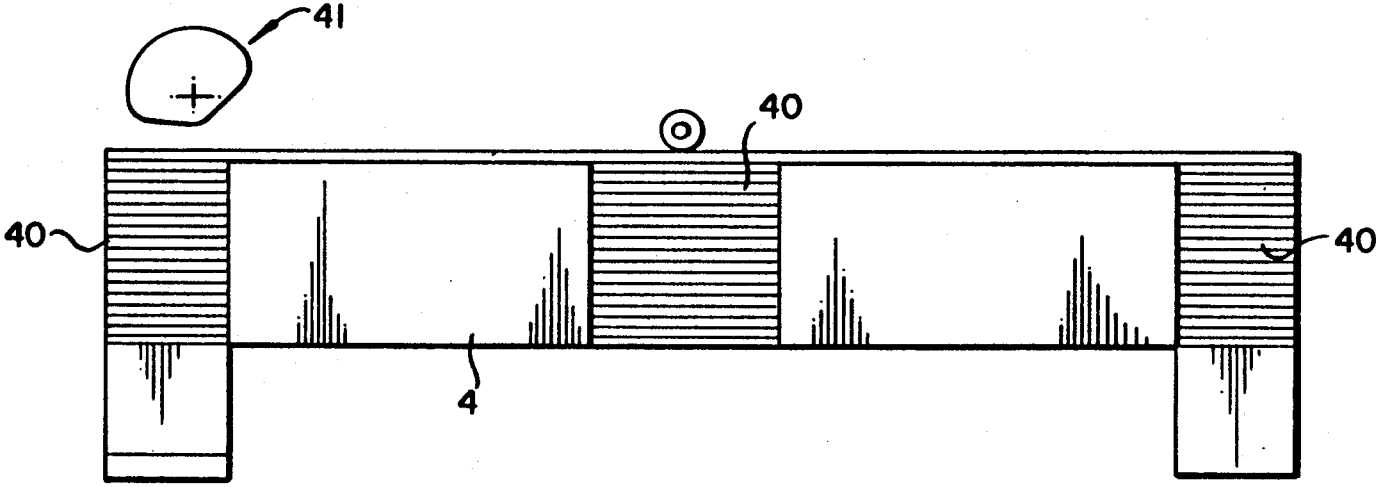
FIG. 7 is a side view of the elevator platform section of the paper supply tray with parts removed for clarity, shown adjacent to a known cam scuff paper feed mechanism of the reproduction apparatus.

Now that the environment for the paper supply tray has been set, the invention may be described by referring to the drawings Referring now to FIG. 1, a reproduction apparatus 1, such as a printing or copying apparatus, has a paper supply tray 2, which is adapted to slide in and out of a paper receiving slot 3 of copier 1. Mounted within paper supply tray 2 is an elevator platform 4 on which print receiving material 40, such as paper sheets, see FIG. 6, are stacked for use in the copying process of copier 1. Unlike standard cassettes normally used in a small copier, such as copier 1, that handle up to 50 sheets, paper supply tray 2 can handle a paper stack in the 500 sheet range. Elevator platform 4, of paper supply tray 2, maintains, as to be discussed later, the top sheet of the paper stack in contact with a paper feed mechanism 41, such as a cam feed roller, as shown in FIG. 7, which is known in the art, or a belt feed roller system, as shown in FIG. 6, which is also known in the art, when paper supply tray 2 is in its normal operating position within slot 3 of copier 1.

Figure 2:
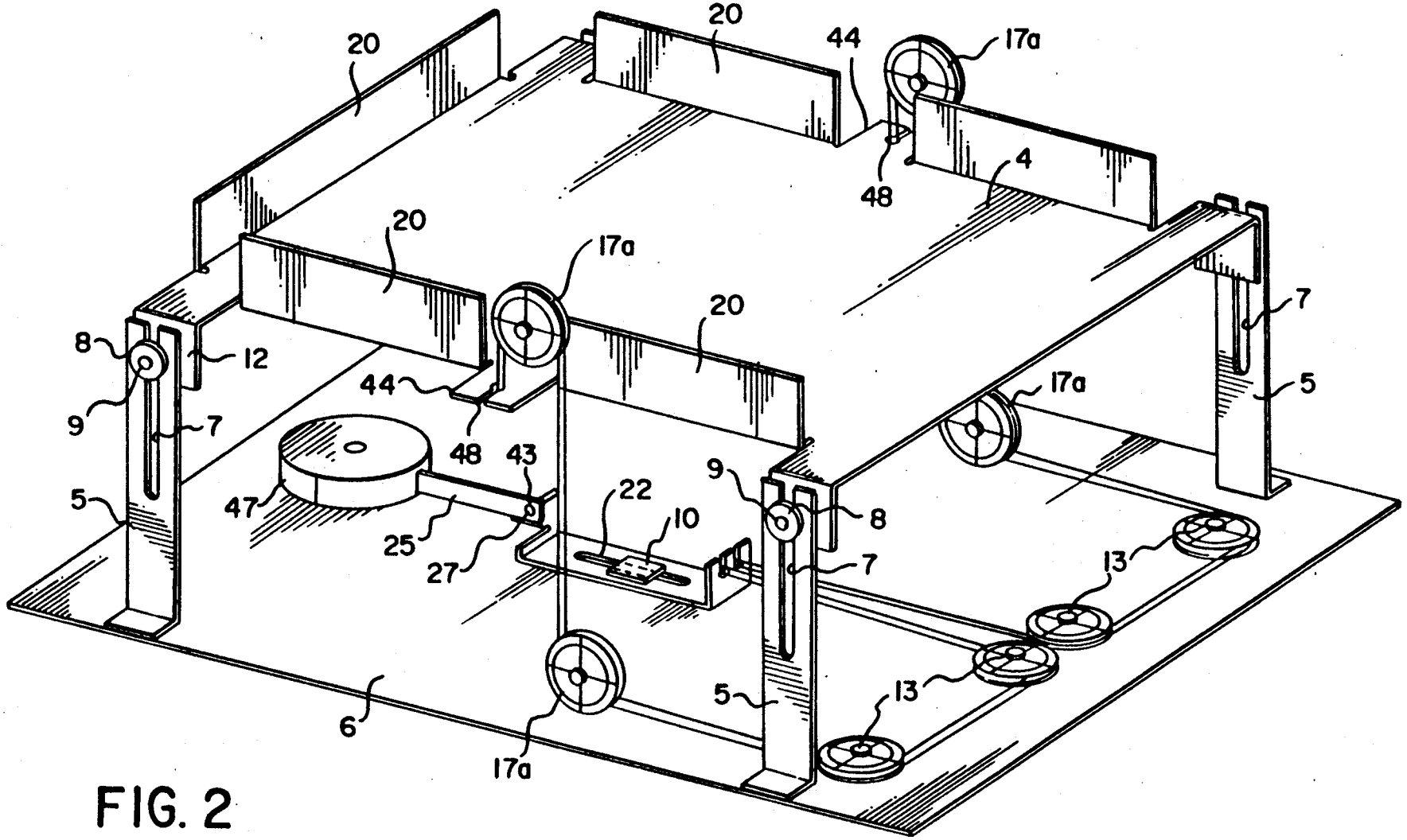
FIG. 2 is a perspective view of an elevator platform section of the paper supply tray showing a spring and sheave lifting system in accordance with the present invention.
Figure 3:
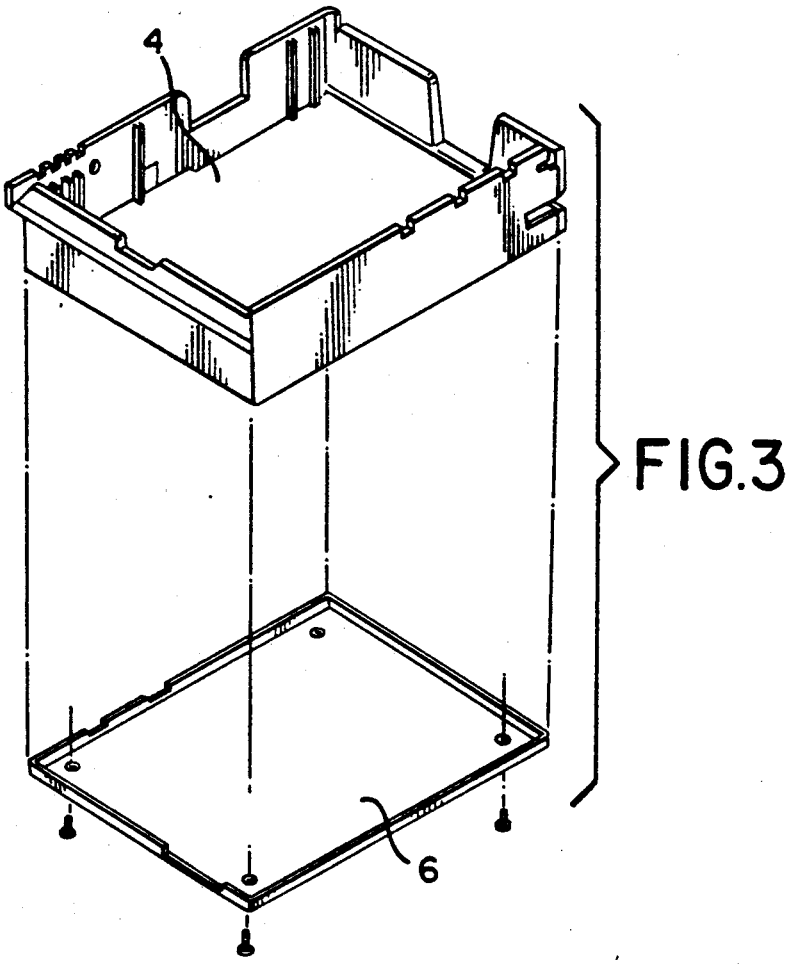
FIG. 3 is a perspective view of the paper supply tray with its support surface removed from the main body of the tray.
Figure 4:
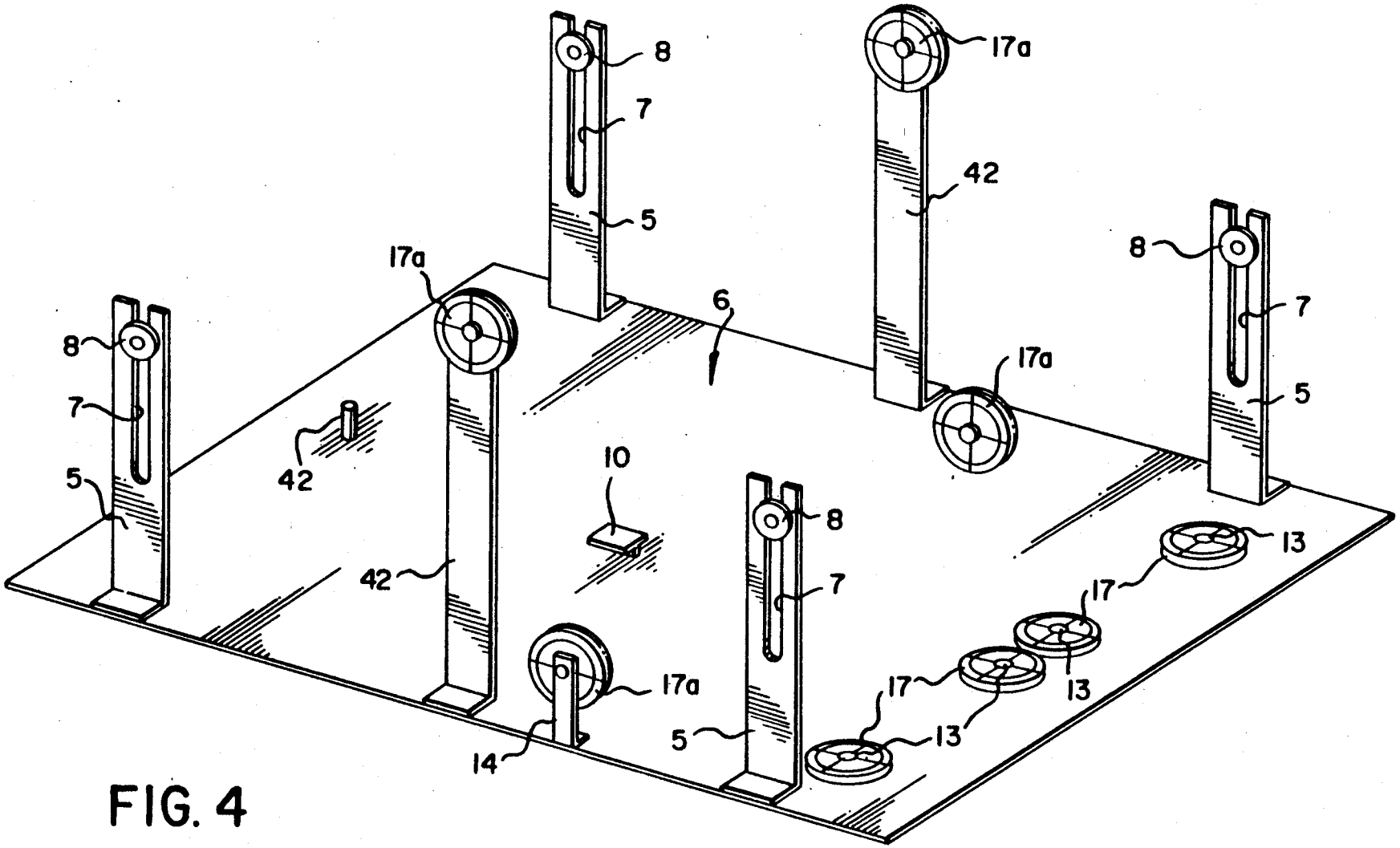
FIG. 4 is a perspective view of the support and guide elements for the elevator platform

As shown in FIG. 4, secured to a support surface 6, of paper supply tray 2, are the following:

a) a stud 42 for mounting a constant force spring 16, see FIG. 10, contained within housing 47, see FIG. 2;

b) a cable retainer bracket guide 10 for guiding the movement of a slidable cable retainer bracket 11, see FIG. 2, as cable retainer bracket 11 slides on support surface 6;

c) guide bars 5 for guiding the perpendicular movement of elevator platform 4, see FIG. 2, in relation to support surface 6;

d) sheave support members 42 and 14 for mounting sheaves 17*a* in rotational movement above support surface 6; and e) sheave retainer mountings 13 for mounting sheaves 17 for rotational movement on support surface 6.

While constant force springs 16, see FIG. 10, are known in the art, briefly stated they are a special variety of extension spring. They consist of a spiral of ribbon material 25 with built-in curvature so that each turn of ribbon 25 wraps tightly on its inner neighbor. When ribbon 25 is extended (deflected), the inherent stress resists the loading force, just as in a common extension spring, but at a nearly constant (zero) rate. This type of spring is well suited to long extensions with no load build-up. In use, the spring is usually mounted with the inside diameter tightly wrapped on a drum and the free end attached to the loading force, such as in a counterbalance application. This relationship can be reversed, however, with the free end mounted stationary and the spring itself providing the working force. With this type of spring there is considerable flexibility because the load capacity can be multiplied by using two or more ribbons 25 in tandem, back-to-back or laminated, as shown in FIG. 10.

Figure 8:
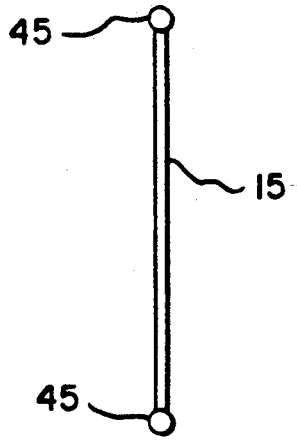
FIG. 8 is a front view of a cable for operatively connecting the elevator platform to the cable retaining bracket.
Figure 9:
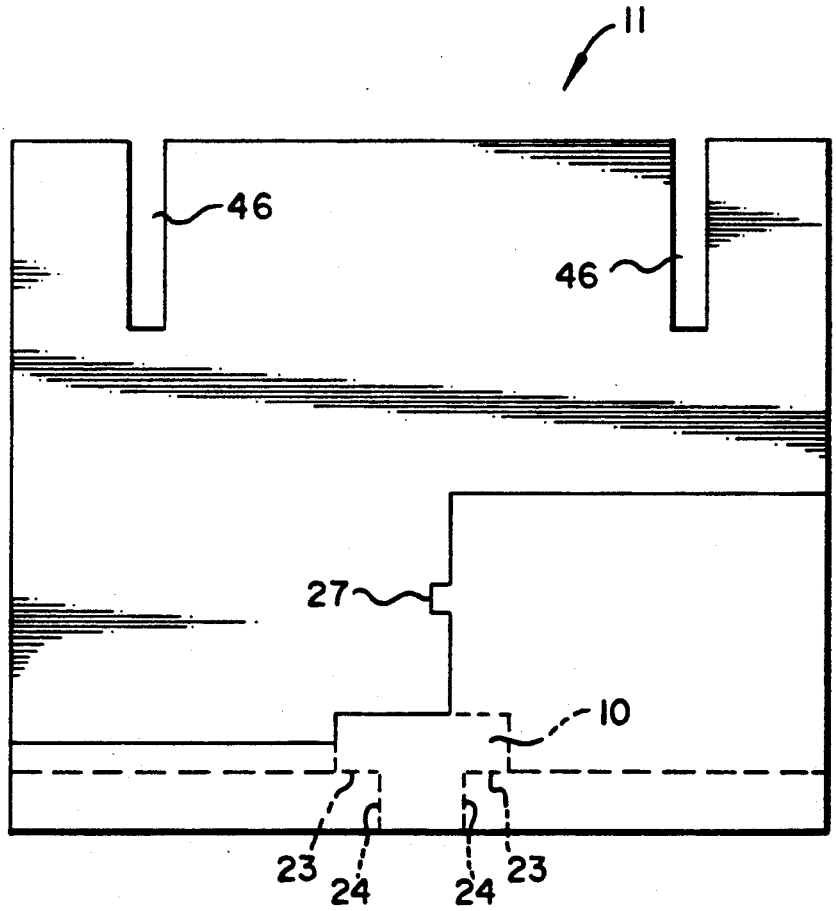
FIG. 9 is a front view of the cable retaining bracket mounted within the cable retaining bracket guide.
Figure 10A:
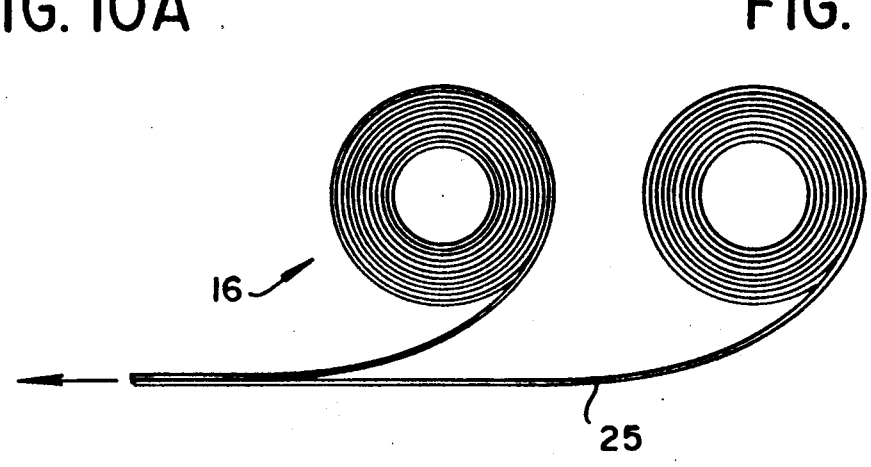
FIG. 10 is a side view of a constant force spring and various combinations of constant force springs.
Figure 10B:
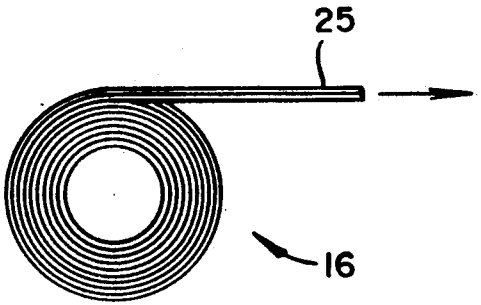
Figure 10C:
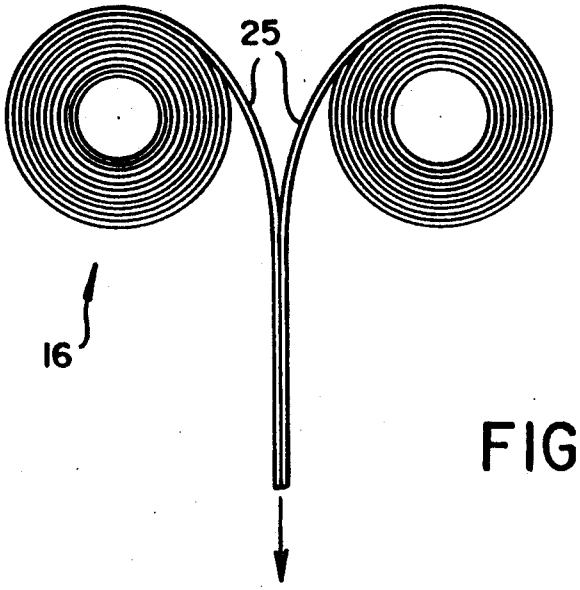
Figure 10D:
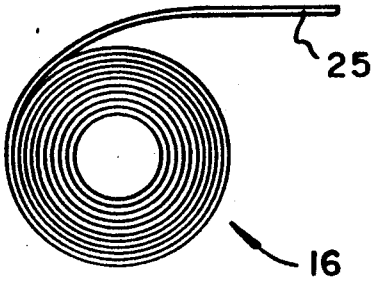

Ribbon 25, as shown in FIG. 2, of constant force spring 16, contained in housing 47, is secured to one end of cable retaining bracket 11 by a retaining hole 43, of ribbon 25, being placed over stud 27, see FIG. 9, of cable retaining bracket 11. The other end of cable retaining bracket 11 is connected, by mounting slots 46, to one end of cables 15. Because cables 15 have spherical surfaces 45 at each end, see FIG. 8, they are easily retained and installed in mounting slots 46, of cable retaining bracket 11, since the width of slots 46 is larger than the diameter of cables 15, but less than the diameter of the spherical surfaces 45, of cables 15.

With cables 15, having one end attached to cable retaining bracket 11, and the other end secured, in slots 48, of tabs 44 on elevator platform 4, the force of constant force spring 16, on cable retaining bracket 11, maintains cables 15 in contact with and threaded over sheaves 17*a* and 17. Slots 48, like mounting slots 46, have a width lager than the diameter of cables 15, but less than the diameter of the spherical surfaces 45 of cables 15, thereby allowing cables 15 to freely move within slots 48, but not dislodge from slots 48.

As shown in FIG. 2, elevator platform 4 has shafts 9, which mount sheaves 8 for rotation within guide bar slots 7, of guide bars 5. This allows elevator platform 4 to move up and down in relation to support surface 6. In this manner sheaves 8 restrict elevator platform 4 to vertical movement relative to support surface 6 and maintain elevator platform 4 spaced apart from guide bars 5 to prevent rubbing, between guide bars 5 and elevator platform 4, as elevator platform 4 moves up and down in relation to support surface 6.

Figure 5:
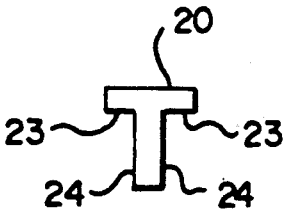
FIG. 5 is a side view of the cable retainer bracket guide, in accordance with the present invention.

To properly transmit the force of constant force spring 16 to elevator platform 4, the movement of cable retainer bracket 11 must be restrained in all but the transverse direction as cable retainer bracket 11 slides on support surface 6; therefore, cable retainer bracket 11 is restricted in all but its transverse movement by cable retainer bracket guide 10. As shown in FIG. 2, cable retainer bracket guide 10 is placed within slot 22 of cable retainer bracket 11, and then secured to support system 6. In this manner surfaces 23, see FIGS. 5 and 9, of cable retainer bracket guide 10 prevent vertical movement and surfaces 24 prevent lateral movement of cable retainer bracket 10, in relation to support surface 6, while freely allowing traverse movement.

Because cable retainer bracket 11 is connected directly to constant force spring 16 and indirectly to elevator platform 4 through cables 15, constant force spring 16 maintains a constant force between the top sheet on elevator platform 4 and feed mechanism 41 of copier 1. This is accomplished by ribbon 25, of constant force spring 16, being extended from housing 47, as elevator platform 4 is loaded with paper and retracted into housing 47, as paper stacked on elevator platform 4 is removed by use or other reasons, to maintain the top sheet on elevator platform 4 in feeding contact with feed mechanism 41, notwithstanding the amount of sheets loaded on elevator platform 4.

If, for any reason, such as a different paper weight stock is to be used in tray 2, a different constant force spring is required to maintain the top sheet in contact with feed mechanism 41 of copier 1, the operator merely replaces the existing constant force spring 16 with a constant force spring 16 that is appropriate. The replacement being relatively simple, since it only requires removal of constant spring 16 and its housing 47 from their mounting stud 42 and the removal of ribbon 25 from its mounting on cable retainer bracket stud 27. The new constant force spring 16 and its housing 47 are then placed on mounting stud 42 and ribbon 25 is placed on stud 27. This replacement relieves the operator of the need to make any other adjustments that could adversely effect the operation of supply tray 2.

To secure the position of the paper loaded into tray 2, sides 20, see FIG. 2, of elevator platform 4, act as sheet retainers and are of a sufficient height to retain at least a ream of the type paper being used.

Because the sheet elevator system in the present copier 1 does not require a motor, the voltage needed to operate copier 1 may be kept to 110 volts, thereby eliminating the need for any special electrical installation at the copier's point of use.

In operation, an operator approaches copier 1 and if copier 1 is in need of paper, the operator slides paper supply tray 2 out from slot 3 in copier 1. As the operator loads paper onto elevator platform 4, elevator platform 4 moves downward toward support surface 6 causing movement of cables 15 and the withdrawal of ribbon 25 from housing 47.

After loading paper onto elevator platform 4, the operator then slides supply tray 2 back into slot 3 of copier 1 and commences to make copies. As copies are made and paper is removed from elevator platform 4, ribbon 25 retracts into housing 47 causing elevator platform 4 to move upwards as the sheets contained on elevator platform 4 are expended. In this manner the top sheet in tray 2 is maintained in feeding contact with feed mechanism 41, notwithstanding the amount of sheets in tray 2.

While the invention has been described in detail with particular reference to a preferred embodiment thereof, it will be understood that variations and modifications can be effected within the spirit and scope of the invention as described hereinabove and as defined in the appended claims.

I claim:

1. A sheet supply apparatus for use in a reproduction apparatus, comprising:

a removable tray assembly adapted to be removable from the reproduction apparatus;

an elevator platform located within said tray assembly for receiving and holding multiple sheets directly on the elevator platform, piled one upon another to form a stack;

guide means, all located in the tray assembly, for guiding the movement of the elevator platform between multiple positions with all positions being parallel to each other;

a spiral constant force spring, located in the tray assembly, for moving and maintaining the elevator platform such that the sheets of the stack may be serially fed for use by the reproduction apparatus; and connecting means, located in the tray assembly, for connecting said spiral constant force spring to the elevator platform.

2. The sheet supply apparatus of claim 1 wherein the connecting means includes;

a cable secured to the elevator platform and the constant force spring and a series of sheaves, about which the cable is entrained, for guiding the cable as the cable imparts movement of the spiral constant force spring to the elevator platform.

3. The sheet supply apparatus of claim 1 wherein the guide means include:

guide bars having guide slots; and sheaves mounted to the elevator platform for rotational movement within the guide slots.

4. A sheet supply apparatus for use in a reproduction apparatus having a sheet feed mechanism, comprising:

a removable tray assembly adapted to be removable from the reproduction apparatus;

an elevator platform located within said tray assembly for receiving and holding multiple sheets directly on the elevator platform, piled one upon another to form a stack;

guide means located in the tray assembly for guiding the movement of the elevator platform between multiple positions with all positions being parallel to each other;

a spiral constant force spring located in the tray assembly for moving and maintaining the elevator platform such that the spring maintains the sheets of the stack under a constant with the sheet feed mechanism of the reproduction apparatus for serially feeding the sheet; and connecting means located in the tray assembly for connecting said spiral constant force spring to the elevator platform.

* * * * *